United States Patent [19]

Woodward et al.

[11] Patent Number: 4,842,097

[45] Date of Patent: Jun. 27, 1989

[54] SOUND ABSORBING STRUCTURE

[76] Inventors: Bruce Woodward; William Miller, both of 912 Baxter Ave., Louisville, Ky. 40204

[21] Appl. No.: 218,212

[22] Filed: Jul. 13, 1988

Related U.S. Application Data

[63] Continuation-in-part of Ser. No. 62,846, Jun. 16, 1987.

[51] Int. Cl.[4] ..... E04B 1/82

[52] U.S. Cl. ..... 181/286; 181/288; 181/290

[58] Field of Search ..... 181/285–288, 181/290, 292, 293, 295

[56] References Cited

U.S. PATENT DOCUMENTS

| | | | |
|---|---|---|---|
| 1,825,770 | 10/1931 | Barnett | 181/293 |
| 2,007,130 | 7/1935 | Munroe et al. | 181/285 |
| 2,335,728 | 11/1943 | Benecke | 181/285 |
| 2,887,173 | 5/1959 | Boschi | 181/292 X |
| 2,913,075 | 11/1959 | Zittle | 181/290 X |
| 2,933,146 | 4/1960 | Zeldastani et al. | 181/285 X |
| 2,989,136 | 6/1961 | Wohlberg | 181/224 |
| 4,071,989 | 2/1978 | Warren | 181/285 X |
| 4,244,439 | 1/1981 | Wested | 181/288 X |
| 4,257,998 | 3/1981 | Diepenbrock, Jr. et al. | 181/286 X |
| 4,279,325 | 7/1981 | Challis | 181/292 X |
| 4,621,709 | 11/1986 | Naslund | 181/288 X |

*Primary Examiner*—B. R. Fuller

*Attorney, Agent, or Firm*—Charles G. Lamb

[57] ABSTRACT

A sound absorbing structure is formed of adjacent panels which provide narrow slots opening into first resonance cavities formed behind the panels. Support strips provide secondary cavities between adjacent first cavities to reduce acoustical coupling between adjacent first cavities. The resulting sound absorbing structure provides substantial sound absorption at frequencies of less than about 1,000 Hz.

15 Claims, 4 Drawing Sheets

SOUND ABSORBING STRUCTURE

CROSS-REFERENCE TO RELATED APPLICATIONS

This is a continuation-in-part of prior patent application Ser. No. 07/062,846 filed on Jun. 16, 1987.

BACKGROUND OF THE INVENTION

1. Field of the Invention

This invention relates to sound absorbing structures, and more particularly to wall and ceiling structures which are designed to absorb sound particularly at frequencies of less than about 1000 Hz.

2. Prior Art

The acoustics of a room or other enclosure depend primarily upon the acoustical properties of its walls, floor and ceiling. Depending upon which material or combination of materials is chosen, the sound absorption of a particular room may vary widely. Wooden paneling, for example, when backed by an air space which may be formed when paneling is installed over furring strips, is a moderate absorber of low frequency sound, but provides little absorption at frequencies above about 1000 Hz. Draperies and curtains oderately absorb medium and higher frequency sounds but absorb little of lower frequency sounds, particularly when they are installed or maintained in close proximity to a rigid wall. Carpeting is relatively effective as an absorber of high frequency sounds out provides little absorption at the lower end of the audible range of acoustic frequencies.

Concrete, masonry, masonry blocks and gypsum boards are frequently employed in modern construction. However, most of these materials are extremely hard and absorb little, if any, sound. Thus, sound damping may be obtained by employing carpeting on floors and by installing porous materials such as acoustical ceiling tiles. However, covering ceilings and floors does not adequately solve all acoustical problems. In fact, even in the presence of carpeting and acoustical ceiling tiles, many sounds will produce ringing or flutter echoes which reflect back and forth between the surfaces of parallel, reflective walls formed of masonry or plaster.

Masonry and other rigid sound absorbing structural elements have been disclosed in patents such as U.S. Pat. No. 2,933,146 in which each masonry block cavity resonates in a Helmholtz manner (see pp. 42–44, *Sensations of Tone*, Herman Helmholtz) with a slot in the cavity wall. U.S. Pat. No. 4,071,989 also discloses a block-type acoustical resonator but these patents do not provide for continuous panels enclosing a single resonance cavity as disclosed herein. U.S. Pat. No. 2,007,130 describes a sound absorption unit which is formed from terra cotta. The cavity behind longitudinal slits disclosed in this patent is completely filled with a sound absorbing material. These units are load bearing elements which are too heavy and too costly for use in normal decorative applications.

The use of curved wall units is also known. See, for example, U.S. Pat. No. 2,913,075. Again, however, the unit described in the patent does not provide the combination of acoustical properties that the applicant's invention does.

U.S. Pat. No. 2,335,728 discloses a floor unit in which the cavity behind the face plate may be open.

U.S. Pat. No. 2,989,136 discloses a sound attenuation mechanism primarily for use with aviation engines. The individual panels, as demonstrated in FIG. 6, require that the opening be relatively similar in size to the length of the covering bodies.

Accordingly, none of these references or patents disclose the use of elongated, thin-walled panels of the type disclosed herein.

Thus, it is an object of this invention to provide a sound absorbing wall structure which has enhanced, low frequency, sound absorption.

It is another object of this invention to provide sound absorptive wall and ceiling structures which may be applied to standard structural room walls and ceilings for decorative effect.

It is a further object of this invention to provide panel mounting means which will allow panels to better absorb sound mechanically at the mechanical resonance frequencies of the mounted panels themselves.

Another object of this invention is to provide a wall and ceiling structure which will absorb sound across much of the audible sound frequency range.

Yet another object of this invention is to provide a sound absorptive wall and ceiling structure which can easily be installed over existing walls and ceilings by installers not having any particular knowledge of acoustics.

These and other objectives are obtained by constructing the apparatus of the instant invention.

SUMMARY OF THE INVENTION

The present invention provides a wall or ceiling structure constructed of outwardly facing panels having first acoustic cavities behind the panels and slots in the panels in air flow communication with the first cavities, and also having second acoustic cavities behind the panels located between adjacent first cavities to reduce acoustical coupling between adjacent cavities. The first cavities are devoid of any insulation material, and the second cavities enclose at least some insulation material.

More particularly, in one embodiment, the invention provides a sound absorbing structure to be located over a supporting surface comprising a panel fabricated of a substantially solid material; at least one elongated slot formed in the panel and extending longitudinally of the panel, the slot being shorter in length than the longitudinal length of the panel such that the ends of the slot are at a distance from the opposite longitudinal ends of the panel; a pair of panel supporting brackets attached to the panel and located to either side of the slot such that when the panel is located over the supporting surface, the panel, supporting surface, and pair of panel supporting brackets cooperate to define a first acoustical cavity with the slot open to the first cavity, and each one of the pair of brackets define a second acoustical cavity; sound absorbing, insulation material inside each of the second cavities; apertures formed in the mounting brackets for establishing communication between the first cavity and the second cavities; and, sound absorbing insulation material located at the interface of the brackets and the panel.

In another embodiment, the invention provides a sound absorbing structure to be located over a supporting surface comprising a plurality of adjacent panels fabricated of a substantially solid material, the panels being disposed in generally edge-by-edge relationship to each other and spaced from each other such that the adjacent side edges of adjacent panels define a slot therebetween; a panel supporting bracket attached to each of the panels between adjacent slots such that when the panels are located over the supporting surface, the panels, supporting surface, and the brackets cooperate to define first acoustical cavities between adjacent brackets with each slot in air flow communication with a difference one of the first acoustical cavities, and each bracket defines a second acoustical cavity; sound absorbing insulation material inside the second cavities; apertures formed in the mounting brackets establishing air flow communication between the first and second cavities; and, sound insulation material at the interface of the bracket and the panel.

In yet another embodiment, the invention provides a sound absorbing structure comprising a plurality of adjacent panels fabricated of a substantially solid material, the panels being disposed in generally edge-by-edge relationship to each other and spaced from each other such that the adjacent side edges of adjacent panels define a slot therebetween; a continuous back wall spaced to the back side of the plurality of panels; panel support brackets disposed between the panels and the back wall and located between adjacent slots, the brackets interconnecting the panels and the back wall such that the panels, back wall, and brackets cooperate to define first acoustical cavities between adjacent brackets with each slot in air flow communication with a different one of the first acoustical cavities, and each bracket defines a second acoustical cavity; sound absorbing insulation material inside the second cavities; apertures formed in the mounting brackets establishing air flow communication between the first and second cavities; and, sound absorbing insulation material at the interface of the brackets and the panels.

BRIEF DESCRIPTION OF THE DRAWINGS

A better understanding of the present invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
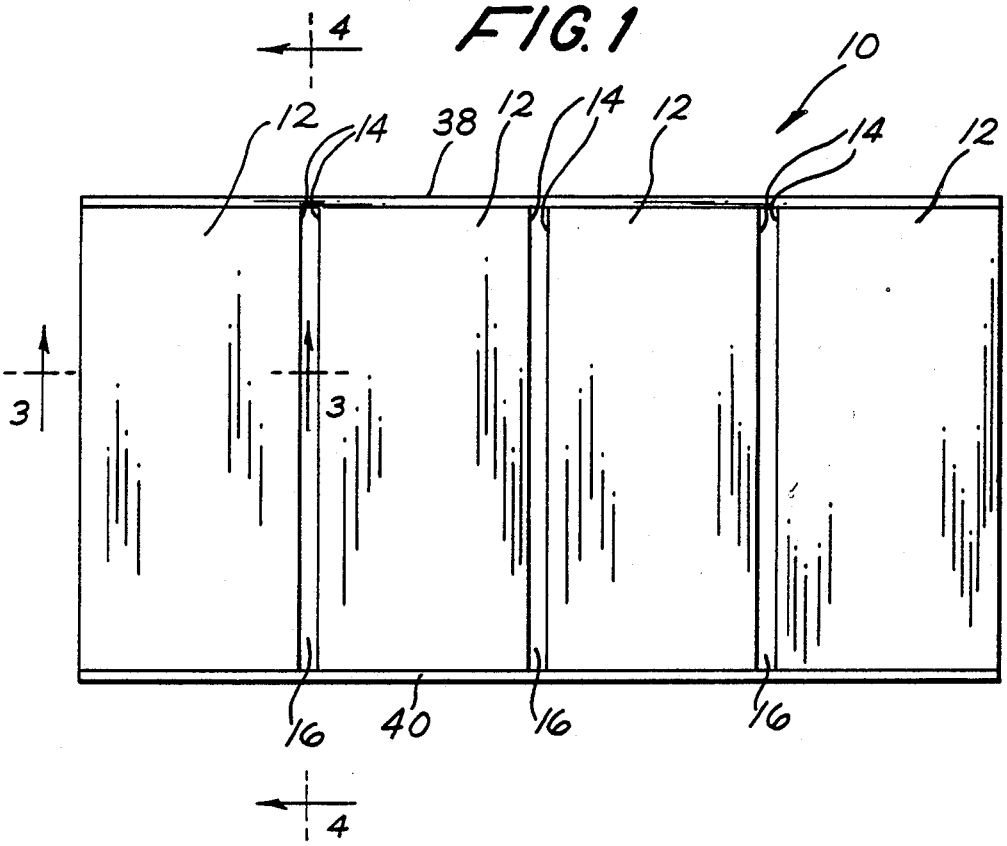
FIG. 1 is a front view of one advantageous embodiment of a sound absorbing structure of the present invention.

With reference to FIGS. 1-4, there is shown one advantageous embodiment of a sound absorbing structure, generally denoted as the number 10, of the present invention which can be used with the wall or ceiling of a room.

As shown, the sound absorbing structure includes a plurality of panels 12 fabricated of a substantially solid, partially reflecting material, such as, for example, wood. The panels 12 face outwardly toward the room in which the sound absorbing structure 10 is used. The panels 12 are disposed in mutual edge-to-edge relationship and are spaced from each other such that the adjacent side edges 14 define a slot 16 therebetween.

Figure 2:
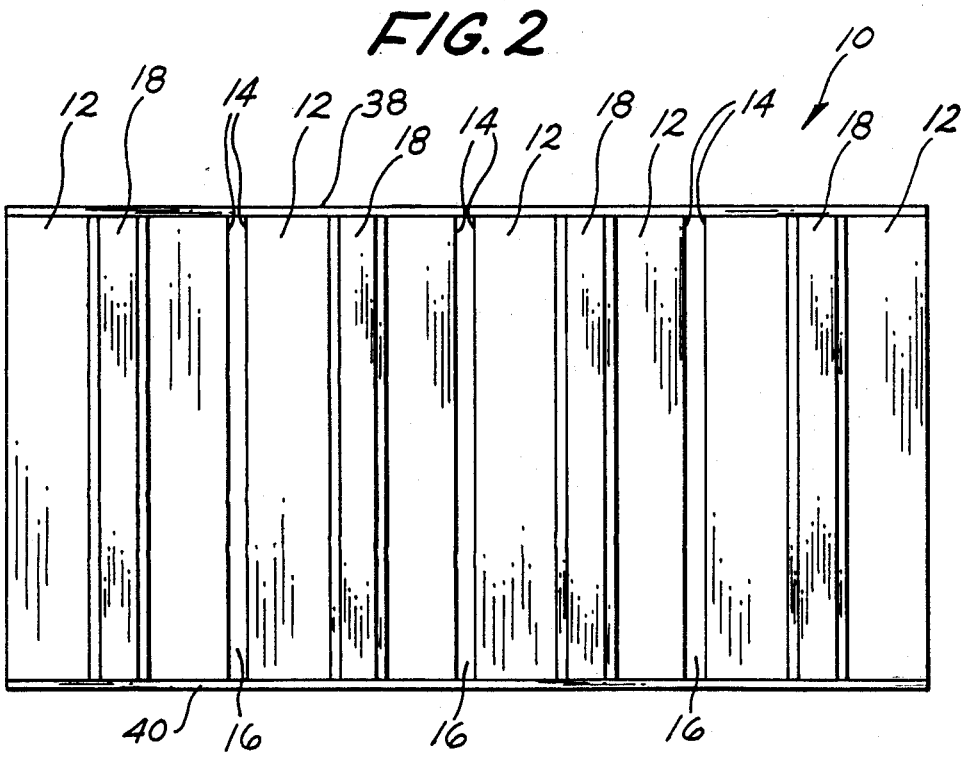
FIG. 2 is a back view of the sound absorbing of FIG. 1.

As can be best seen in FIG. 2, the sound absorbing structure 10 further includes panel support brackets 18 attached to the back side of the panels 12 between adjacent slots 16. The support brackets 18 extend the entire length of the panels 12 and support the panels 12 over a supporting surface such as a wall 20 of the room in which the sound absorbing structure 10 is to be used. When the sound absorbing structure 10 is positioned over the wall 20, the panels 12, the wall 20, and the support brackets 18 mutually cooperate to define first acoustical cavities 22 between adjacent support brackets 18 such that each one of the slots 16 is in air flow communication with a different one of the first acoustical cavities 22. As shown, each one of the slots 16 is transversely centered on a different one of the first cavities.

Figure 3:
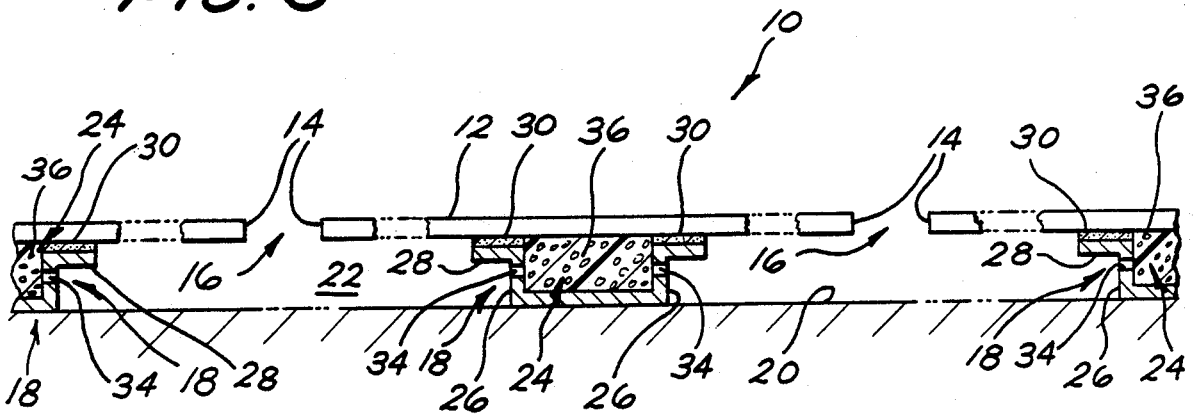
FIG. 3 is an enlarged cross sectional view of a portion of the embodiment of FIGS. 1 and 2 as seen in the direction of arrows 3—3 in FIGS. 1 and 2.
Figure 4:
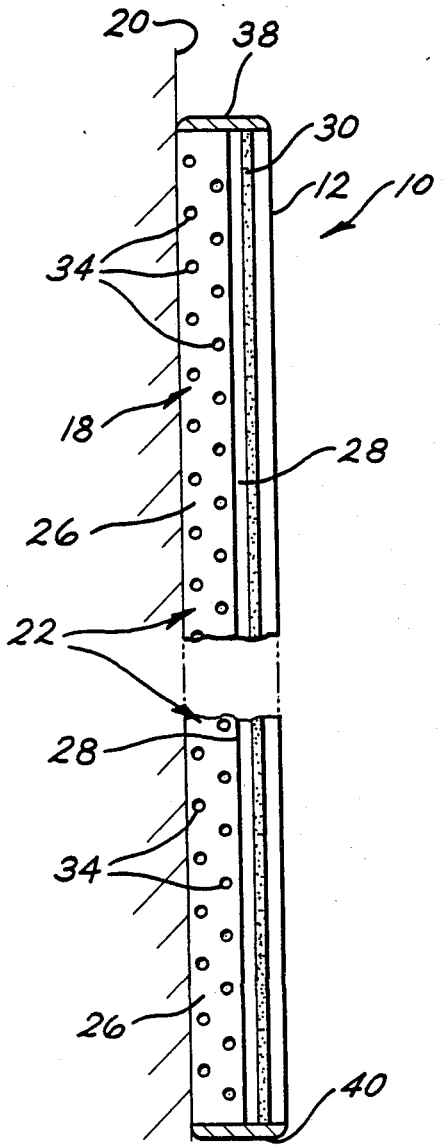
FIG. 4 is an enlarged side view of the embodiment of FIGS. 1 and 2 as seen in the direction of arrows 4—4 in FIGS. 1, 2 and 3.

As can be best seen in FIGS. 3 and 4, each bracket 18 is configured to define a second acoustical cavity 24 which extends along the entire length of the panels 12 and, therefore, the entire length of one first acoustical cavity 22. The second acoustical cavities 24 are substantially smaller in width than are the first acoustical cavities 22. As shown, the bracket 18 is generally U-shaped in transverse cross-section. Each leg 26 of the U-shaped bracket 18 has a transversely projecting flange 28 at the distal end thereof. The bracket 18 concavely faces toward the backside of the panel 12 with the flanges 28 in juxtaposition with the backside of the panel 12. A sound insulation material 30 with adhesive material on both sides is located at the interface of each flange 28 at the backside of the panel 12 to isolate the bracket 18 from the panel 12 and to cushion vibrations and dampen the sound at the surface of the panel 12. The adhesive material of the insulation material 30 is provided to prevent the insulation material 30 from shiting out of location between the bracket flanges 28 and panel 12. The bracket 18 and insulation material 30 can be affixed to the panel 12 by, for example, the adhesive material. The U-shaped bracket 18 cooperates with the back side of the panel 12 to define the second acoustical cavity 24. The bracket 18 is also formed with apertures 34 through the legs 26 of the bracket 18 to establish sound wave communication between the second acoustical cavity 24 and the first acoustical cavities 22 adjacent to the second acoustical cavity 24.

Furthermore, as can be best seen in FIG. 3, the second acoustical cavity 24 is at least partially filled with sound insulation and sound absorbing material 36. The sound insulation/absorbing material 36 can be virtually any process material such as, for example, fiberglass, open cell foam, and loose felt. The first cavities 22 function as an acoustical capacitance and the second acoustical cavity 24 functions to reduce, if not eliminate, acoustical coupling between adjacent first acoustical cavities 22.

Figure 5:
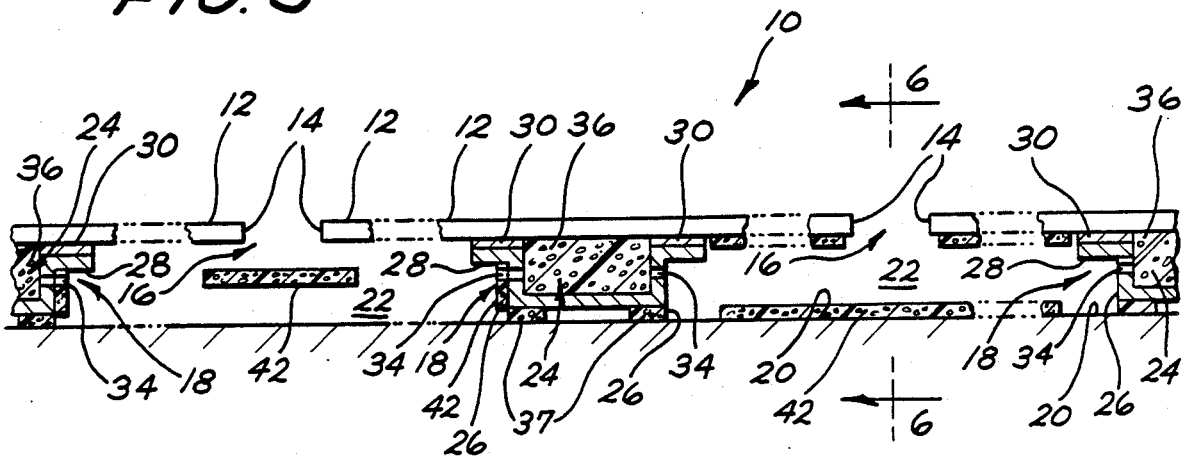
FIG. 5 is an enlarged cross sectional view of a portion of FIGS. 1 and 2 similar to that of FIG. 3, but showing a somewhat different embodiment.

With reference to FIG. 5, there is shown a modified embodiment of the sound absorbing structure 10 which includes all of the features of the embodiment of FIGS.

3 and 4 and includes an additional feature directed to the positioning of additional sound insulation material. For the sake of brevity, the common features are denoted as the same numbers and the description will not be repeated. The embodiment of FIG. 5 includes strips of sound insulation material 37 located at the interface of the bracket 18 and wall 20 over which the panels 12 are to be located. As shown, two parallel strips of sound insulation material 37 are used, but it is contemplated that a single strip of sound insulation material 37 centered on the bracket 18 is equivalent. The strip of sound insulation material 37 can be a foam material with an adhesive on both sides for adhesive attachment to both the bracket 18 and wall 20 to prevent the insulation material 37 from shifting out of location therebetween. The insulation material 37 functions to cushion vibrations of the panel 12 and bracket 18 and isolate these vibrations from the underlaying wall 20 over which the panel 12 is to be located.

The panels 12 can be sized to extend from the floor to the ceiling of a room in which case the floor and ceiling abutting the bottom end and top end of the panel 12 closes the bottom end and top end of the first acoustical cavities 22 and second acoustical cavities 24. It is contemplated, however, that the panels 12 may not be sized to extend completely from floor to ceiling of the room in which event a top end closure 38 can be attached to the panel 12 to close the top end of the first cavity 22 and top end of the second cavity 24, and a bottom end closure 40 can be attached to the panel 12 to close the bottom end of the first cavity 22 and bottom end of the second cavity 24.

The acoustical effect of applying the structure of the instant invention to a wall section is to increase the sound absorption of the wall section to nearly 100 percent at the Helmholtz resonance frequency, of, for example, 1000 Hz, and to provide substantially increased sound absorption at neighboring frequencies as well. Also, by forming the structures described herein so that the resonance cavities of difference diminsions are constructed, it is possible to produce high absorption structures which absorb sound over a broad range of frequencies.

The length of the panels employed to form the resonance cavities is at least three and preferably eighteen or more times the width of each panel unit. The panels are generally rectangular in shape and are preferably no thicker than necessary to maintain structural integrity. The distance between adjacent slots is relatively small, on the order of 4 to about 12 inches. The slots themselves should have a width in the range of about 1/16 to about ¾ inch. The panels are preferably attached to the support brackets such that a constant width slot is provided, but the slot's width may vary as long as the overall average distance between adjacent panels is maintained in the 1/16 to ¾ inch range.

Figure 6:
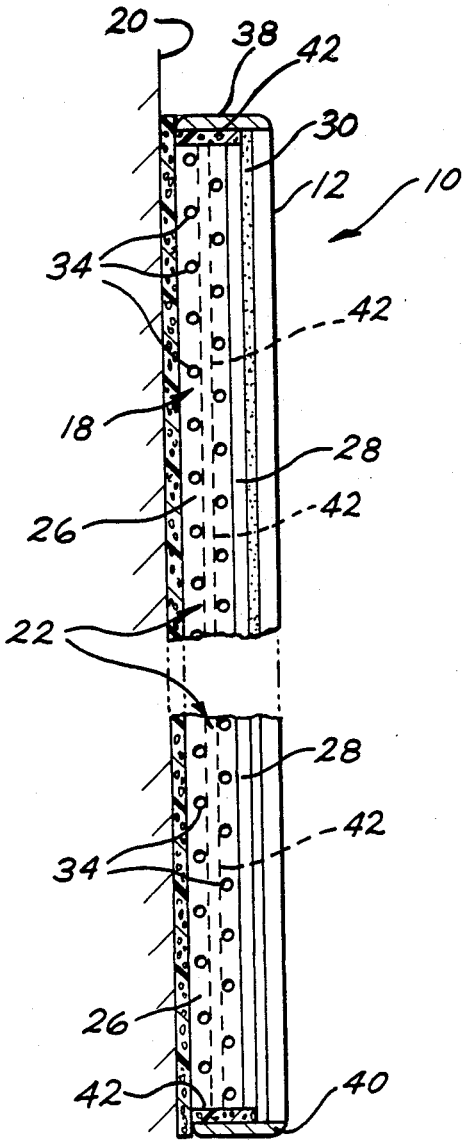
FIG. 6 is an enlarged side view of FIGS. 1 and 2 similar to that of FIG. 4, but showing a somewhat different embodiment.

With reference to FIGS. 5 and 6, in order to increase the efficient absorption frequency range, the present invention also contemplates a fibrous, sound absorbing material 42 installed within the first acoustical cavity 22. Sound incident upon the slotted surface exterior passes through the narrow slots, by diffraction around the corners, into the first acoustical cavities 22 where the fibrous material 42 absorbs much of the sound before it can exit the slot 14. The sound absorbing material 42 may be attached to the support brackets 18, to the top end closure 38, to the bottom end closure 40, to the inner or back surfaces of the panels 12 or it may be suspended within the first cavity 22 itself.

Figure 7:
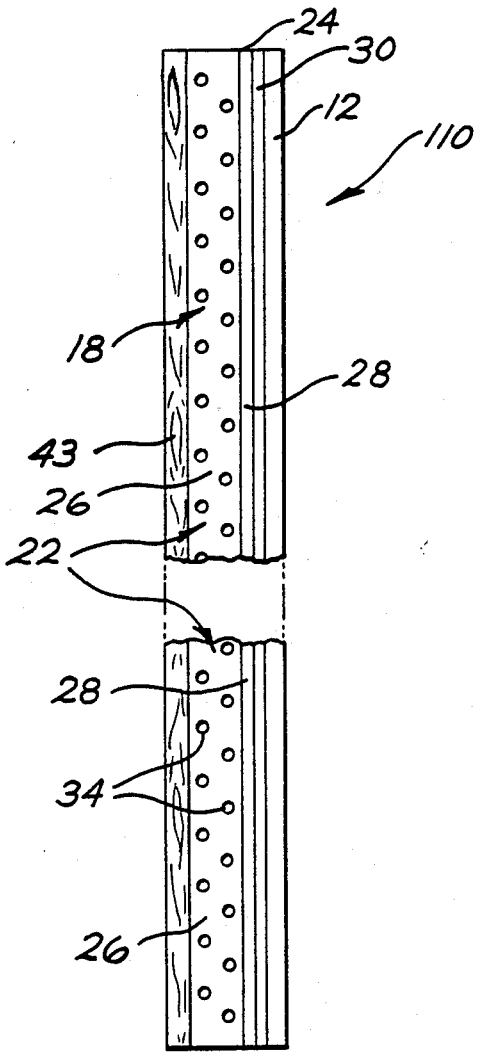
FIG. 7 is a side view of another embodiment of the present invention.

Now with reference to FIG. 7, there is shown another embodiment of the sound absorbing structure of the invention, generally denoted as the numeral 110. The sound absorbing structure 110 is identical to the sound absorbing structure 10 of FIG. 1–4 and includes every feature of the sound absorbing structure 10. Therefore, the identical numerals are used in FIG. 7 as were used in FIGS. 1–4 to denote these common features and, for the sake of brevity, the description thereof will not be repeated. In addition to all of the features of the sound absorbing structure 10, the sound absorbing structure 110 also includes a continuous back wall 42 spaced from the back side surface of the panels 12. The brackets 18 interconnect the panels 12 and back wall 42 in spaced apart relationship such that the panel 12, back wall 42, and brackets 18 cooperate to define the first acoustical cavities 22. When the second absorbing structure 110 is installed in a room, the back wall 42 is positioned to overlay the room wall, or the sound absorbing structure 110 can be used to form the room wall itself, such as a partition dividing the room into smaller areas.

Figure 8:
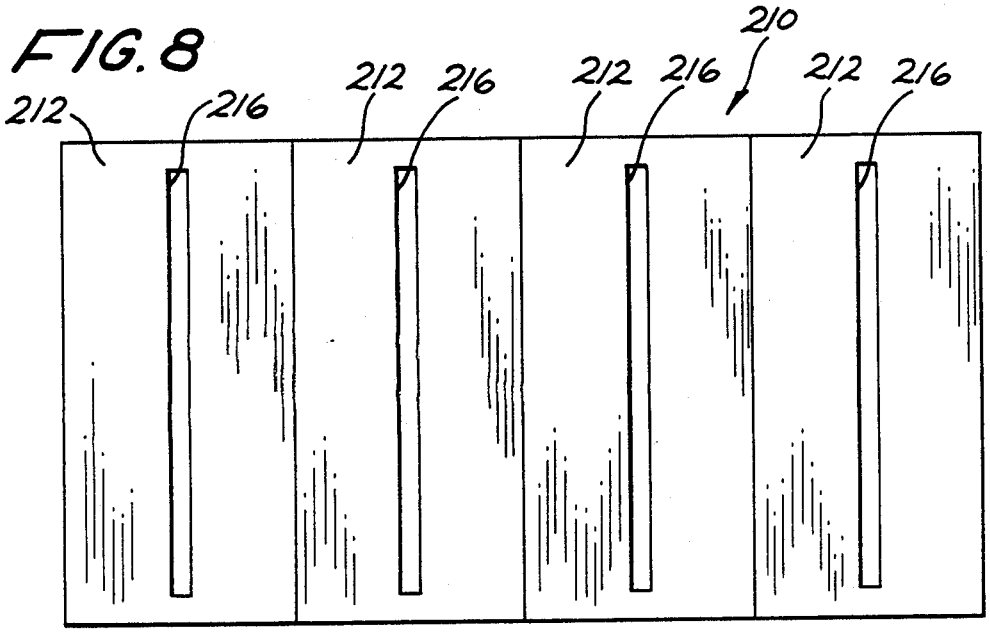
FIG. 8 is a front view of yet another embodiment of the present invention.

Now turning to FIG. 8, there is shown yet another embodiment of the sound absorbing structure of the invention, generally denoted as the numeral 210. The sound absorbing structure 210 is identical to the sound absorbing structure 10 of FIGS. 1–4 and includes all of the features of the sound absorbing structure 10, therefore, the identical numerals are used in FIG. 8 as were used in FIGS. 1–4 to denote these common features and, for the sake of brevity, the description thereof will not be repeated. The only difference between the sound absorbing structure 210 and the sound absorbing structure 10 is that the absorbing structure 210 includes somewhat different panels 212 in place of the panels 12. The panels 212 are disposed in edge-to-edge abutment, and are each formed with at least one elongated slot 216 extending longitudinally of the panel 212. The slot 216 is shorter in length than the longitudinal length of the panel 212 such that the ends of the slot 216 are at a short distance from the opposite longitudinal ends of the panel 212.

The sound waves move through the slots 16, 216 into the first cavity 22. The air in the slots 16, 216 provides acoustical inertness. The first acoustical cavity 22 serves as an acoustical capacitance. The combination of the mass of air in the slot 16, 216 and the resilience of the air in the first acoustical cavity 22, as it is alternatively compressed and expanded by the flow of air into and out of the first acoustical 22 when the sound wave is incident upon the exterior surface panels 12, 212, functions as a Helmholtz resonator. The sound waves then pass from the first cavity to the second cavity through the apertures in the brackets. The second acoustical cavities 24 function to reduce or eliminate acoustic coupling between adjacent first cavities 22. The sound absorbing structures 10, 110 and 210 provide a large percentage of sound absorption in the low end of the frequency range. As pointed out above, the acoustical resonance frequency of the structure of the instant invention may be changed or broadened by altering the relative sizes of the first resonance cavities 22 by, for example, appropriately positioning the brackets 18 to provide different width first cavities 22.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A sound absorbing structure to be located over a supporting surface comprising:

a plurality of adjacent panels fabricated of a substantially solid material, the panels being disposed in generally edge-by-edge relationship to each other and spaced from each other such that the adjacent side edges of adjacent panels define a slot therebetween;

a panel supporting bracket attached to each of the panels between adjacent slots such that when the panels are located over the supporting surface the panels, the support surface, and the brackets cooperate to define first acoustical cavities between adjacent brackets with each slot in air flow communication with a different one of the first acoustical cavities, and each bracket defines a second acoustical cavity;

sound absorbing insulation material inside the second cavities; and apertures formed in the mounting brackets establishing communication between the first and second cavities whereby reflected sound waves enter said second cavity from said first cavity to be absorbed by the sound absorbing material therein.

2. The sound absorbing structure of claim 1, further comprising sound absorbing material inside the first cavities.

3. The sound absorbing structures of claim 1, wherein the first cavities are wider than the second cavities.

4. The sound absorbing structures of claim 1 comprising sound absorbing insulation material at the interface of the support brackets and the panels.

5. The sound absorbing structure of claim 1 comprising sound absorbing insulation material at the interface of the support brackets and the supporting surface.

6. A sound absorbing structure comprising:

a plurality of adjacent panels fabricated of a substantially solid material, the panels being disposed in generally edge-by-edge relationship to each other and spaced from each other such that the adjacent side edges of adjacent panels define a slot therebetween;

a continuous back wall spaced to the back side of the plurality of panels;

panel support brackets disposed between the panels and the back wall and located between adjacent slots, the brackets interconnecting the panels and the back wall such that the panels, back wall, and brackets cooperate to define first acoustical cavities between adjacent brackets with each slot in air flow communication with a different one of the first acoustical cavities, and each bracket defines a second acoustical cavity;

sound absorbing insulation material inside the second cavities;

apertures formed in the mounting brackets establishing air flow communication between the first and second cavities whereby reflected sound waves enter said second cavity from said first cavity to be absorbed by the sound absorbing material therein; and, sound absorbing insulation material at the interface of the brackets and the panels.

7. The sound absorbing structure of claim 6, further comprising sound absorbing material inside the first cavities.

8. The sound absorbing structure of claim 6, wherein the first cavities are wider than the second cavities.

9. The sound absorbing structure of claim 6, comprising sound absorbing insulation material at the interface of the support brackets and the continuous back wall.

10. A sound absorbing structure to be located over a supporting surface comprising:

a panel fabricated of a substantially solid material;

at least one elongated slot formed in the panel and extending longitudinally of the panel, the slot being shorter in length than a longitudinal length of the panel such that ends of the slot are at a distance from opposite longitudinal ends of the panel;

a pair of panel supporting brackets attached to the panel and located to either side of the slot such that when the panel is located over the supporting surface the panel, supporting surface, and pair of panel supporting brackets cooperate to define a first acoustical cavity with the slot open to the first cavity, and each one of the pair of brackets define a second acoustical cavity;

sound absorbing insulation material inside each of the second cavities;

apertures formed in the mounting brackets for establishing communication between the first cavity and the second cavities whereby reflected sound waves enter said second cavity from said frist cavity to be absorbed by the sound absorbing material therein; and, sound absorbing insulation material located at the interface of the brackets and the panel.

11. The sound absorbing structure of claim 3, further comprising means for closing the top and bottom of the first cavity.

12. The sound absorbing structure of claim 10, further comprising sound absorbing material inside the first cavities.

13. The sound absorbing structure of claim 10, wherein the first cavities are wider than the second cavities.

14. The sound absorbing structure of claim 10, comprising sound absorbing insulation material at the interface of the support brackets and the panels.

15. The sound absorbing structure of claim 10, comprising sound absorbing insulation material at the interface of the support brackets and the supporting surface.

* * * * *